United States Patent [19]

Reis

[11] 4,103,124

[45] Jul. 25, 1978

[54] PLUG-IN PRESSURE SWITCH

[75] Inventor: Robert D. Reis, Hingham, Mass.

[73] Assignee: United Electric Controls Company, Watertown, Mass.

[21] Appl. No.: 752,028

[22] Filed: Dec. 20, 1976

[51] Int. Cl.[2] ..... B65D 35/32

[52] U.S. Cl. ..... 200/51 R; 73/729; 200/83 R; 200/83 B; 200/83 V

[58] Field of Search ..... 200/51 R, 51.09, 51.1, 200/81 R, 82 C, 83 R, 83 B, 83 N, 83 P, 83 Q, 83 V; 73/389, 410

[56] References Cited

U.S. PATENT DOCUMENTS

| | | | |
|---|---|---|---|
| 2,732,450 | 1/1956 | Stevenson | 200/82 C |
| 3,158,703 | 11/1964 | De Smidt | 200/51 R |
| 3,875,358 | 1/1975 | Willcox | 200/83 Q X |
| 3,916,130 | 10/1975 | Cade | 200/51 R X |
| 3,952,611 | 4/1976 | Cumming | 200/83 R X |

*Primary Examiner*—Stephen Marcus

*Attorney, Agent, or Firm*—Dike, Bronstein, Roberts, Cushman & Pfund

[57] ABSTRACT

An air pressure instrument embodying a base receptacle adapted to be mounted to an instrument panel and to be connected to air and electric lines at the panel and a plug-in receptacle containing a pressure-responsive element and switch operable thereby adapted by plugging into the base receptacle to automatically connect the pressure-responsive element to the pressure line and the switch to the electric line.

23 Claims, 15 Drawing Figures

PLUG-IN PRESSURE SWITCH

BACKGROUND OF INVENTION

The pressure-sensing and electrical switch components of pressure-operated switches are generally built into the instrument and, when supplied by the manufacturer, are mounted on an instrument panel and connected to the pressure and electric lines at the instrument panel by shutoff valves, T's, junctions and the like which require the services of licensed plumbing and electrical workers. As thus connected, in the event that an instrument must be replaced, repaired, calibrated or tested, it must be removed which, again, requires the services of licensed plumbing and electrical workers, which is expensive and represents a loss of service time. Moreover, the necessity for employing shutoff valves, junctions and the like at the mounting panel makes it difficult to bank the instruments compactly to reduce the space required for instrumentation to a minimum. It is the purpose of this invention to provide a pressure switch wherein the pressure-sensing and electrical components may be removed as a self-contained unit from the instrument for replacement, repair, calibration, testing and the like without requiring dismounting of the instrument as a whole from the mounting panel and, hence, without the need for shutoff valves, T's, junctions and the like. The provision of a self-contained unit has the further advantages that, when removed for repair, testing, calibration and the like, it may be replaced by a standby unit without loss of time and by shop personnel while the malfunctioning unit is being repaired or tested; that it is possible for the manufacturer to construct instrument panels with instruments already mounted thereto with the exception of the sensing and electrical units, thereby providing a substantial saving in manufacturing costs and initial installation cost; making possible more uniform arrangement of the instruments on the panel; providing for expansion of services without entailing the added cost of the sensing units by including in the instrument panel as constructed one or more empty instruments which may be on the spot completed by adding a sensing unit thereto; and a unit which can be used independently of the instrument for comparison purposes. Other advantages of construction obtained are improved repeatability and sensitivity over a range of 3 to 15 psi; on and off differentials of 1.624 inches wc with a repeatability of a set point of plus or minus ½ percent fs; a tamperproof resistance scale adjustment and the option of electrical continuity when the sensing component is removed.

SUMMARY OF INVENTION

As herein illustrated, the pressure-sensing instrument comprises a base receptacle adapted to be connected to the air pressure and electric lines at an instrument panel and a plug-in receptacle containing pressure-sensing means and electric switch means operable thereby which are automatically connected to the pressure and electric lines by plugging of the plug-in receptacle to the base receptacle. The base receptacle contains a pressure chamber provided with an inlet opening adapted to be coupled to the pressure lines at the panel and terminal blocks adapted to be connected to the electric lines or circuits at the panel. There is a normally closed valve in the outlet port of the chamber which is automatically opened to place the pressure chamber in communication with the sensing means when the plug-in receptacle is plugged in and to close the port when unplugged and bayonet-type coupling elements associated with the switch means and connected to the terminal blocks on the base receptacle adapted to be coupled and uncoupled by plugging and unplugging of the receptacles of the instrument. The pressure-responsive element is a bellows mounted in the plug-in receptacle with one end fixed and the other end movable and the switch means is a microswitch provided with an actuating pin and terminal posts. A rigid arm is pivotally mounted in the plug-in receptacle with one end adjacent the movable end of the bellows and the other end adjacent the actuating pin of the microswitch so that expansion of the bellows will effect operation of the switch. There is means adjustably connecting the arm for adjusting its resistance to movement in response to the pressure-responsive means, and an indicator and a scale along which the indicator is adapted to move for visibly indicating the response of the instrument to pressure changes. The plug-in receptacle containing the bellows, microswitch, connecting arm and means for effecting adjustment of the instrument to the pressure range desired may be removed and replaced as a unit from the base receptacle and plug-in means are provided in part by close-fitting telescoping engagement of a nipple at the fixed end of the bellows with the outlet port of the chamber, which nipple operates to automatically open the normally closed valve therein and telescoping engagement of the terminal post on the microswitch with sockets on the base receptacle, plug means on the two receptacles which are telescopically interengageable, said means being in the form of a recess in one receptacle and a protrusion on the other.

The invention will now be described with reference to the accompanying drawings, wherein.

The device comprises two interchangeable parts, a receptacle 10 adapted to be connected to the pressure and electric lines at the place of installation and a receptacle 12 embodying pressure-sensitive means and switch means adapted to be connected, respectively, to the pressure and electric lines by plugging of the receptacles and to be disconnected by unplugging of the receptacles.

Figure 4A:
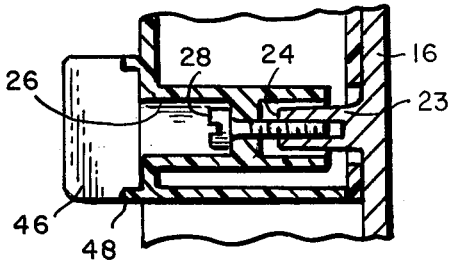
FIG. 4A is a section taken on a line 4A—4A of FIG. 3.

The receptacle 10 is of generally rectangular, horizontal and vertical cross section having a back wall 16, spaced parallel side walls 18—18, a curved bottom wall 20, a flat top wall 22 and an open front. A pair of spaced parallel hollow interiorly threaded studs 23—23, FIG. 4A, are fixed at their inner ends to the back wall 16 of the receptacle so as to extend outwardly therefrom and upon those studs is mounted a subassembly 25, FIGS. 5 and 6, dimensioned to fit into the receptacle between the side wall over the internally threaded studs, being provided with openings 24—24 at the inner side for receiving the studs and openings 26—26 at the outer side for receiving screws 28—28 which are screwed into the studs for securing the subassembly in the receptacle.

Figure 5:
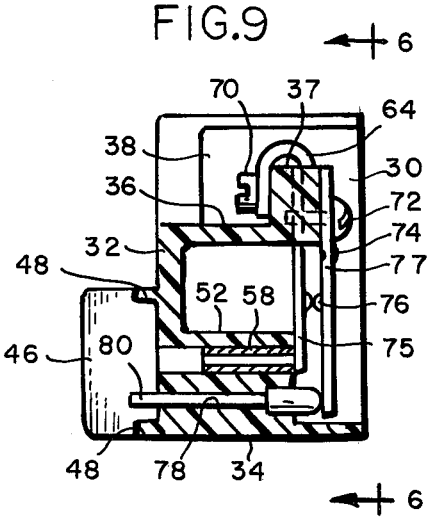
FIG. 5 is a view partially in section of a subassembly removed from the receptacle shown in FIGS. 3 and 4.
Figure 6:
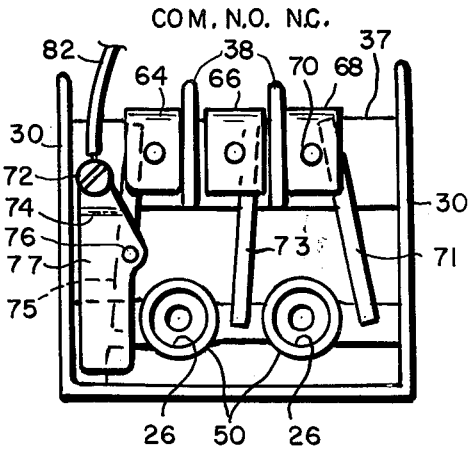
FIG. 6 is an elevation of the subassembly taken on the line 6—6 of FIG. 5.

The subassembly 25, as shown in FIGS. 5 and 6, is comprised of molded resin and thus electrically nonconductive and is generally cubicle in configuration having spaced parallel side walls 30—30 which fit between the side walls 18—18, a front wall 32 which extends from side wall to side wall, a bottom wall 34 and a top wall 36 substantially midway between the lower and upper ends of the side walls which extends rearwardly from the front wall parallel to the bottom wall, terminating short of the rear edges of the side walls. At the rear edge of the top wall, there is a vertical panel 37 which is divided forwardly and rearwardly into three stalls by spaced parallel walls 38—38 spaced from each other and parallel to the side walls. The side walls at the front of the subassembly are extended forwardly from the front to provide spaced parallel mounting tongues 46—46 and extending transversely of the front wall between the edges of the tongues there are spaced parallel reinforcing ribs 48—48, one of which is an extension of the bottom wall and the other of which is formed integral with the front wall. The tongues and ribs collectively provide means for plugging the receptacle 10 to the receptacle 12.

Figure 3:
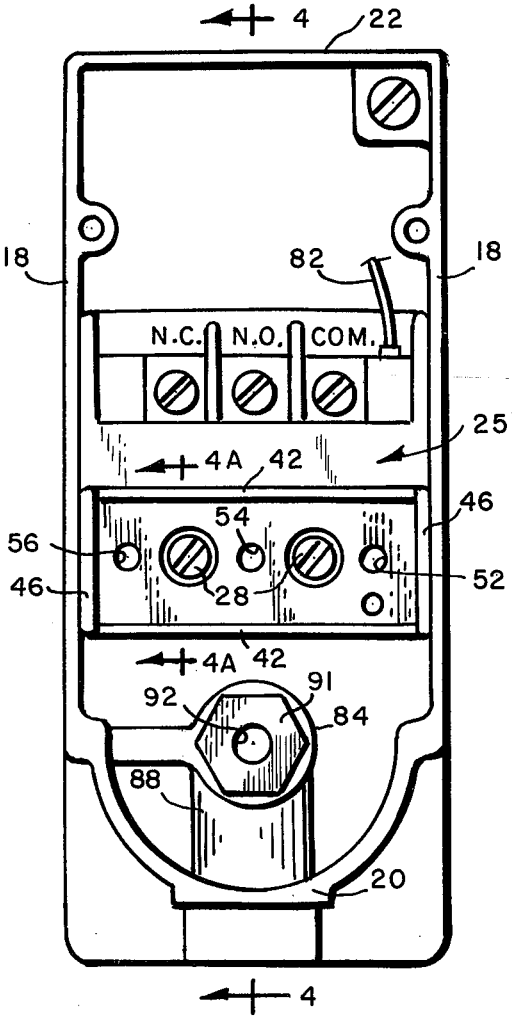
FIG. 3 is a front elevation to larger scale with the plug-in receptacle removed.
Figure 4:
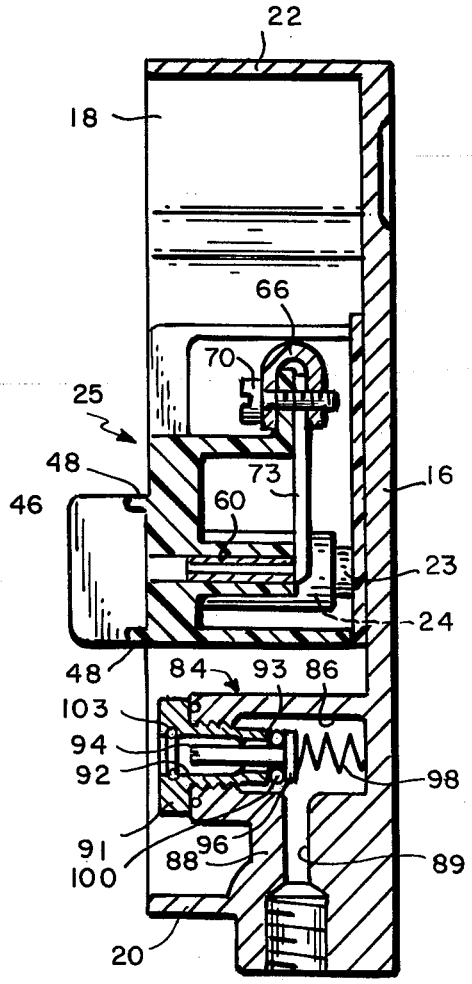
FIG. 4 is a section taken on a line 4—4 of FIG. 3.

Within the chamber defined by the front wall, side walls, bottom wall and top wall, there are two horizontally disposed socket members 50—50 which define the openings 24—24 and 26—26 and, in addition, there are horizontally disposed socket members 52, 54 and 56, FIG. 3, one of which is situated between the socket members 50—50 and the other two of which are situated between the socket members 50—50 and the side walls. In each of the socket members 52, 54 and 56, there is a resilient metal terminal sleeve 58, 60 and 62, FIGS. 4 and 5. U-shaped metal terminal clips 64, 66 and 68 are secured in the stalls by means of screws 70 threaded through the clips and holes in the panel 37. Flat metal conductors 71, 73 and 75 are secured at one end to the respective U-shaped terminal clamps between the rear side of the panel 37 and the rear sides of the clamps by tightening the clamp screws 70. The opposite ends of the conductors are inserted through openings at the inner ends of the socket members and soldered or welded to the respective terminal sleeves 58, 60 and 62. In order to maintain circuit continuity (normally open and normally closed) when the receptacles are unplugged, there is fastened to the rear side of the panel 37 by means of a screw 72, FIGS. 5 and 6, threaded into the panel, one end of a flat metal bridge plate 77, FIG. 6, which extends cantilever fashion from the panel to the lower end of the subassembly in a plane parallel to the conductors which is spring-biased by means of a crimp 74 at its proximal end to hold a pin 76 fixed to it intermediate its ends in engagement with the conductor 75. A socket 78 is provided at the bottom of the subassembly within which is slidingly mounted an actuator element 80 with one end adjacent the bridge plate and its other end extending forwardly from the front wall parallel to the side walls. A shunt wire 82 is connected at one end to the proximal end of the bridge plate and at its other end is optionally connected to one or the other of the two terminal clips 64 and 66.

The three terminals comprise a common terminal 64, a normally open terminal 66 and a normally closed terminal 68 so that a normally open and a normally closed microswitch may be used in the circuit. Assuming that the normally closed and common terminal are connected in the power circuit to be controlled and the wire 82 is connected at one end to the normally closed terminal 68 and at its other end to the bridge plate, so long as the bridge plate holds the pin 76 in engagement with the common conductor 75, the power circuit will be completed from the normally closed terminal through the bridge to the common terminal. If the bridge is deflected to disengage the pin, the circuit will be interrupted. Similarly, if the shunt wire 82 were to be connected at one end to the normally open terminal 66 and at its other end to the bridge plate, so long as the pin was held in engagement with the bridge plate, the circuit would be completed from the normally open terminal and bridge to the common terminal. Disengagement of the pin would break the circuit. The circuitry is thus designated to enable using a normally open and normally closed microswitch either to maintain the circuit under control in continuous operation or to maintain it in operation only when controlled.

Alternatively, the bridge 77 and actuating element 80 may be omitted, for example, where there is no need for maintaining the circuit while the receptacle is unplugged, or the shunt wire may simply be disconnected, thus rendering the bridge and actuating element inoperable.

Figure 1:
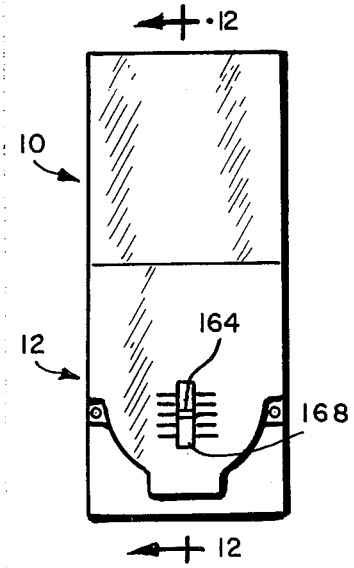
FIG. 1 is a front elevation of the instrument.
Figure 2:
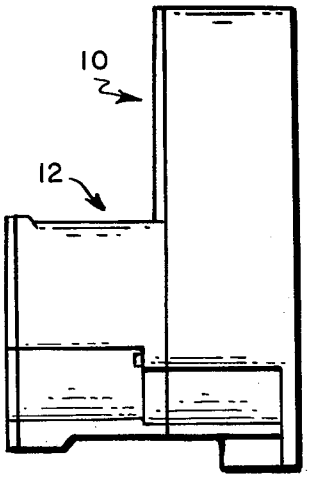
FIG. 2 is a side elevation of the instrument.

At the lower end of the receptacle 10 below the subassembly 25, as shown in FIGS. 1 and 2, there is a part 84 which defines a valve chamber 86 open at the front and closed at the back and a part 88 intermediate the open front and closed back which defines a port 89 extending from the valve chamber through the bottom wall of the receptacle. The open end of the valve chamber 86 is internally threaded and an externally threaded valve sleeve provided with a head 91 is screwed into the open end. The valve sleeve contains a passage 92 at the inner end of which there is an annular valve seat 93. A valve element comprising a stem 94 with a flanged head 96 at one end is supported with the stem in the passage and the head adjacent the annular valve seat 93 by a coil spring 98 situated within the chamber between the inner end of the sleeve and the rear end of the chamber. The spring 98 normally urges the valve head toward the seat and to provide for a good seal, an O-ring 100 is placed about the spindle 94 so as to be squeezed between the head 96 and the annular valve seat 93 by the pressure of the spring. A second O-ring 101 is placed in a groove formed in the end of the part 84 around the open end of the chamber to form a seal between the head 91 of the sleeve and the threaded end of the chamber and a third O-ring is recessed into a groove at the inner side of the open end of the passage 92 in the sleeve for forming a seal between the open end of the passage and a coupling element to be described hereinafter designed to be telescopically inserted into the open end of the passage.

The lower end of the receptacle 10 contains a threaded opening in communication with the port 89 for receiving a threaded nipple for connecting the instrument to a pressure line.

Figure 7:
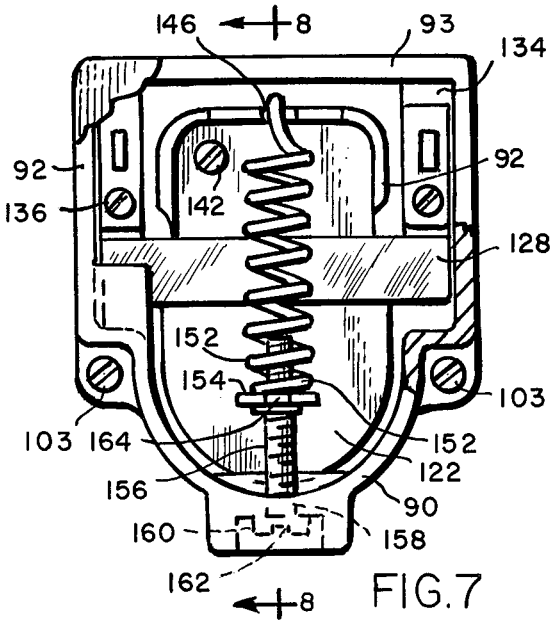
FIG. 7 is a front view of the plug-in receptacle with the cover removed.
Figure 8:
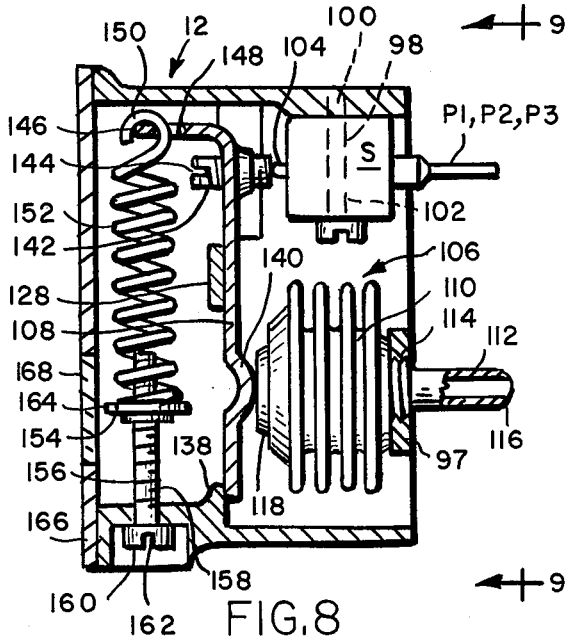
FIG. 8 is a section taken on the line 8—8 of FIG. 7.
Figure 9:
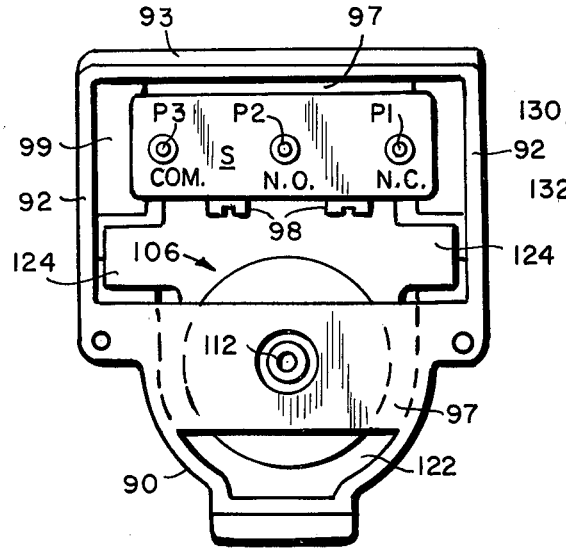
FIG. 9 is a rear view of the plug-in receptacle taken on the line 9—9 of FIG. 8.

The receptacle 12, FIGS. 7 to 9, defines a chamber of generally rectangular section having a bottom wall 90 corresponding substantially in curvature to the bottom wall of the receptacle 10, spaced parallel side walls 92—92 which correspond to the spacing of the side walls in the receptacle 10, but which are shorter, and a top wall 83. The edges of the bottom wall and side walls of the receptacle 12 thus coincide with the edges of the bottom and side walls of the receptacle 10 and abut the same. The receptacle 12 is open at the front and back and across the open front there is a web 97, FIG. 9, which defines in conjunction with the side wall 92—92 and top wall 93 a substantially rectangular opening 99 corresponding in rectangular dimension with the peripheral dimensions of the tongues and ribs which project from the front side of the receptacle 10 and, in effect, constitute a female socket within which the tongues and ribs are adapted to be pressed and by reason of the elastic displacement of the tongues and ribs to firmly plug the receptacle 12 into the receptacle 10. Both receptacles may be provided with matched openings for receiving screws 103 to secure them after they have been plugged to each other by the aforesaid plug-in construction. The screws may be used as a precaution to prevent too easy, unauthorized removal, but are not necessary to maintain the component parts in operative relation to each other.

Figure 10:
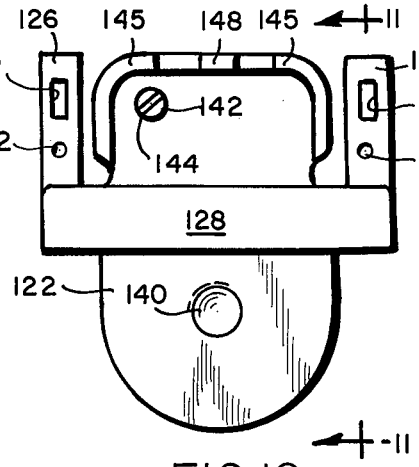
FIG. 10 is a plan view of an actuator arm removed from the plug-in receptacle.
Figure 11:
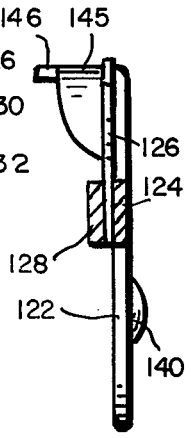
FIG. 11 is a view taken on the line 11—11 of FIG. 10.
Figure 12:
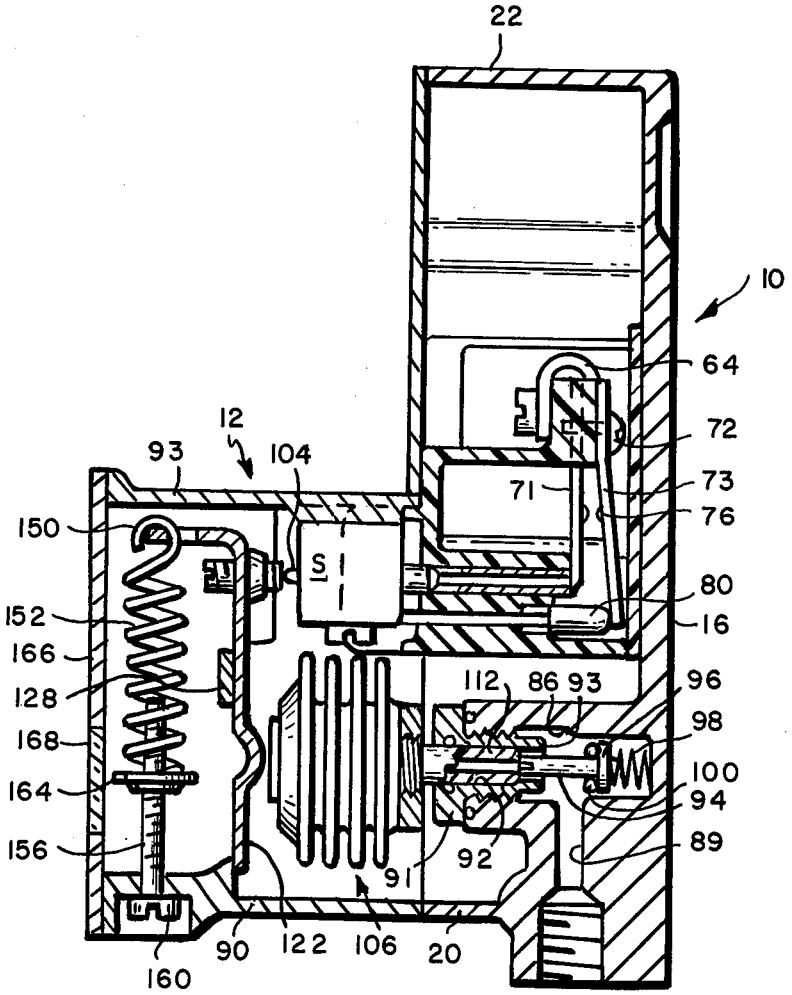
FIG. 12 is a section taken on the line 12—12 of FIG. 1 with the component receptacle assemblies.

A microswitch S is mounted in the chamber 99 against an inwardly extending boss 97 at the inner side of the top wall by means of screw bolts 98 inserted through threaded holes 100—100 in the boss and holes 102—102 in the microswitch capsule. The microswitch has three fixed terminal posts or pins P1, P2, P3, FIGS. 8 and 9, which extend rearwardly therefrom and from the rear side of the receptacle at a spacing corresponding to the spacing of the terminal sleeves in the subassembly — a common terminal post P3, a normally open terminal post P2, and a normally closed terminal post P1. A single actuating pin 104 projects from the forward side of the microswitch. The microswitch is actuated in response to the expansion of an expansion element 106 by means of an arm 108. The expansion element 106 is a bellows element 110 at one end of which is a tubular nipple 112 provided with a threaded portion 114 and a tapered tip 116. The nipple 112 provides communication with the interior of the bellows element. The bellows is brass and there is a flat stainless steel wear plate 118 affixed to the end opposite that from which extends the nipple. The web 97 contains a threaded opening 120 into which the threaded portion 114 of the bellows element is threaded so that the nipple 112 projects rearwardly from the receptacle parallel to the pins. The arm 108 which is actuated by the expansion element and, in turn, actuates the actuator pin 104, comprises a rigid arm 122, FIGS. 10 and 11, having intermediate its ends at right angles to its longitudinal axis oppositely projecting limbs 124—124. A pair of flat, flexible hinge plates 126—126 are secured to these limbs parallel to the axis of the arm by a rigid bar 128 welded to the arm and to the limbs over the end of the hinge plates. The hinge plates contain slots 130—130 and holes 132—132 which, respectively, provide for positioning the hinge plates on shoulders 134—134 at the inner side of the receptacle and fixing them by means of screws 136—136 so that the arm is supported with one end adjacent the forward end of the bellows element 106 and the other end adjacent the actuating pin 104 of the microswitch and can rock about a horizontal axis. The rocking movement in a clockwise direction is limited by engagement of the one end of the arm with a shoulder 138 formed at the inner side of the receptacle. A hemispherical boss 140 is formed on the arm for engagement with the center of the wear plate. At the other end of the arm, a stud 142 is threaded through the arm in a position such that its inner end engages the actuator pin 104 of the microswitch. The outer end of the lug contains a slot 144 by means of which it may be adjusted in the arm. For adjusting the resistance of the arm to movement in response to a predetermined pressure, there is a flange 145 containing a notch 146 and a hole 148 for receiving a hook 150 at one end of a coil spring 152. The other end of the coil spring has threaded to it by means of a coupling element 154 one end of a screw bolt 156, the other end of which passes through a hole 158 in the receptacle and has on it a head 160 containing a slot 162 by means of which the bolt can be rotated to adjust the tension of the spring and, hence, the resistance of the arm to clockwise displacement in response to the pressure of the bellows. The coupling element 154 has on it an index element 164 and there is a cover plate 166, FIGS. 8 and 12, fastened to the front of the receptacle which contains a window 168 on which there is a scale. Movement of the index element 164 relative to the plate can be seen through the window.

Figure 13:
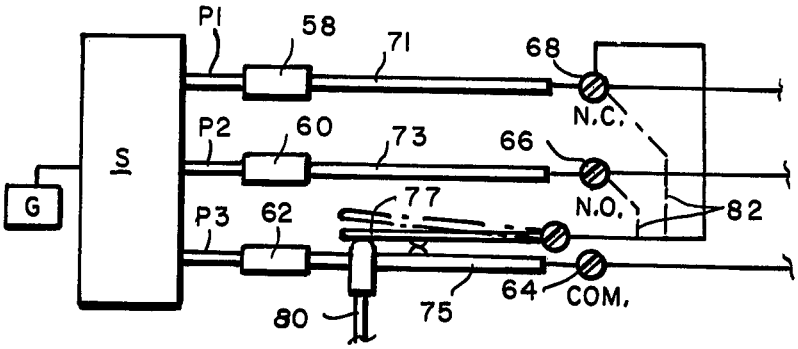
FIG. 13 is a wiring diagram illustrating the circuitry utilizing a shunt.
Figure 14:
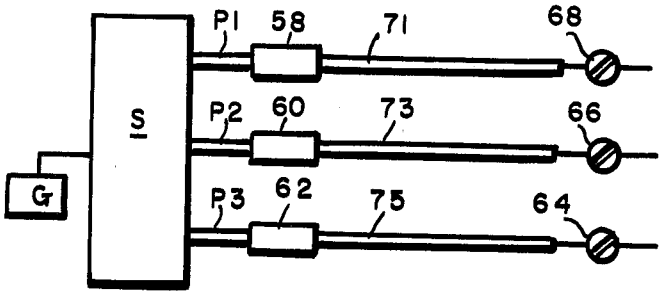
FIG. 14 is a wiring diagram illustrating alternative circuitry without a shunt for maintaining circuit continuity when the component receptacles are unplugged.

The instrument as aforesaid is comprised of two receptacles designed to be removably plugged into each other and so constructed that the base receptacle which remains on the mounting panel automatically seals off the air and current flow when the plug-in module constituting the other receptacle is removed for the purpose of calibrating, testing or setting the sensing element and switch and this is provided for by the tongues and ribs on the receptacle 10 which frictionally engage within the opening in the receptacle 12 and by interengagement of the microswitch pins within the terminal sleeves and the nipple within the valve passages. In the circuitry illustrated in FIG. 13 wherein a shunt is used, when the receptacles are plugged into each other, the circuit is automatically established through the microswitch and when they are unplugged, it is maintained uninterrupted through the bridge so that there is no interruption of the circuit. As related, the microswitch has both normally closed and normally open contacts and, hence, the instrument can be used for maintaining the power circuit in operation either by closing the microswitch or opening the microswitch. In the circuitry illustrated in FIG. 14 where the shunt is omitted, when the receptacles are plugged, the circuit is automatically established and, when unplugged, the circuit is opened.

The instrument as thus constructed with a base receptacle which can be permanently mounted to the instrument panel either at the site or at the place of manufacture and a plug-in receptacle containing the sensing element and switch means together with linkage and adjustment for effecting calibration which can be removed and replaced by plugging of the plug-in receptacle or unplugging thereof provides the advantages that the shop technician can easily handle the work necessary for making replacements, testing and the like without the expense of union workers, removal for the aforesaid purposes can be carried out without loss of time or interruptions of the service, shutoff valves, T's, electrical conduits and the like may be eliminated, thus materially reducing the space requirements up to approximately a 50 percent reduction in instrument unit size, and the base receptacle may be constructed on the instrument panel by the panel manufacturer and the plug-in receptacles sent to the site, thus affording a savings in manufacture and installation. Further advantages are derived from the fact that the plug-in receptacle as a unit may be used as a compact pressure control unit apart from its use in the instrument; that the plug-in arrangement provided by the quick connect, disconnect terminals eliminates the need for tools in servicing the instruments; that the pressure sensor connection is made first, thereby insuring that the snap switch is in proper process mode before making the electrical connection and that the removal of front facing of the instrument affords access to the terminals for line testing without removing the plug-in receptacle.

It should be understood that the present disclosure is for the purpose of illustration only and includes all modifications or improvements which fall within the scope of the appended claims.

I claim:

1. An instrument comprising a base receptacle adapted to be connected to air pressure and electric lines, a plug-in receptacle embodying pressure-sensitive and switch means operable thereby, and means operable by mounting the plug-in receptacle to the base receptacle to automatically connect the pressure-sensing means to the pressure line and, when dismounted therefrom, to automatically close the pressure line and disconnect the electric line.

2. An instrument according to claim 1 wherein there are mutually interengageable means associated with the receptacles for plugging the receptacles to each other.

3. An instrument according to claim 2 wherein said mutually engageable means comprises means defining a recess in the facing side of one receptacle and means defining a protuberance on the facing side of the other receptacle of a dimension to fit into the recess.

4. An instrument according to claim 1 wherein said means operable by mounting the plug-in receptacle to the base receptacle comprises mutually interengageable slip-fitting components, interengagement of which place the sensing means in communication with the pressure in the pressure line and completes a current path between the switch means and the electric line.

5. An instrument according to claim 1 wherein the plug-in receptacle containing the pressure-sensing and switch means, together with means for adjustably connecting the two, is mounted to the face of the instrument at the upper end and there is a removable face plate below the plug-in receptacle, removal of which provides access to the electric terminals for in-line testing without unplugging the plug-in receptacle.

6. An instrument comprising a base receptacle adapted to be mounted to an instrument panel or like support and to be permanently connected to air pressure and electric lines at the panel, a plug-in receptacle embodying as a unit pressure-sensitive and switch means wherein the switch means is responsive to the pressure-sensitive means to which the pressure-sensing means is subjected and means automatically operable by a mounting of said plug-in receptacle to the base receptacle to connect the pressure-sensing means to the pressure line and the switch means to the electric line.

7. An instrument comprising a base receptacle containing a pressure chamber adapted to be connected to a pressure line and a terminal adapted to be connected to an electric circuit, a plug-in receptacle embodying a pressure-sensitive element and an electric switch, said switch being operable by the pressure-sensing element and means automatically operable by mounting the receptacles to each other to connect the pressure-sensing means with the pressure chamber and the switch means to the terminal.

8. An instrument according to claim 7 wherein the pressure chamber contains a normally closed port and the terminal is in the form of a socket and wherein the pressure-sensitive element embodies a nipple interengageable with the normally closed port to open the latter and thus place the sensing element in communication with the chamber and the switch has a terminal post slidingly interengageable with the socket to complete an electric connection between the switch and circuit.

9. An instrument according to claim 8 wherein the means adapted by interengagement with the port to open same is operable to connect the sensing means to the pressure chamber before the means for connecting the switch to the socket becomes effective.

10. An instrument according to claim 8 wherein the means operably connecting the pressure-sensitive means and the switch comprises a rigid arm, means pivotally supporting the arm in the second receptacle with one end adajacent the pressure-sensitive means and the other end adjacent the switch, a spring connected at one end to the end of the arm adjacent the switch, said spring extending from said end adjacent the switch toward the other end, a threaded adapter at the other end of the spring and a screw rotatably supported on the plug-in receptacle in axial alignment with the axis of the spring and threaded into the adapter.

11. An instrument according to claim 10 wherein the pressure-sensitive means is a bellows fixed at one end to the other end of which is affixed a hardened disk and the arm has a convex nub centered thereon for engagement with the disk.

12. An instrument according to claim 10 wherein the adapter has on it a marker movable therewith, and the plug-in receptacle has a window opening through which the marker can be seen, said window having marginally thereof a scale representing units of pressure in psi.

13. An instrument according to claim 10 wherein the screw is recessed into the outer side of the receptacle so as to be relatively tamperproof.

14. An instrument according to claim 8 wherein the switch has normally open and normally closed terminal posts and the base receptacle a corresponding number of sockets for receiving said normally open and normally closed terminal posts.

15. An instrument according to claim 8 wherein the switch has a common terminal and normally open and normally closed terminals and the base corresponding sockets for receiving said terminals, a shunt movable by interengagement of the receptacles to shunt the current in the line from the common terminal through the switch to the normally open terminal or to the normally closed terminal.

16. An instrument according to claim 15 comprising means for connecting the shunt of either the normally closed or normally open terminal and means mounted on the base receptacle with an end in a position adjacent the shunt to effect movement thereof to shunt the circuit in the line through the switch when the receptacles are plugged and to short-circuit the switch when the receptacles are unplugged without interrupting continuity of current flow in the line.

17. An instrument according to claim 16 wherein there is an actuatable element mounted on the base receptacle with a part projecting from the face to which the plug-in receptacle is plugged operable by such plug-in to effect operation of the shunt.

18. An instrument comprising a first receptacle containing a pressure chamber adapted to be connected to a pressure line and an electric socket adapted to be connected to an electric line, said pressure chamber containing a port, a normally closed valve element situated in the chamber closing said port, a second receptacle adapted to be mounted to the first receptacle, a sensing element and switch contained by the second receptacle, said switch being operably connected to the sensing element such that operation of the sensing element effects operation of the switch, means associated with the sensing element and the switch adapted by interengagement with the port and the socket to open the normally closed valve element and, hence, connect the pressure chamber to the sensing means and to complete an electric circuit between the switch and the socket, said second receptacle being removable from the first to remove the sensing element and switch as a unit and simultaneously to restore the valve to its closed position and break the electric circuit.

19. An instrument according to claim 18 wherein there is means for automatically closing the valve element when the receptacles are dismounted.

20. An instrument according to claim 18 wherein the sensing means is a bellows operable by expansion in response to pressure within the pressure chamber to actuate the switch means.

21. An instrument comprising a first receptacle adapted to be connected to pressure and electric lines, a second receptacle adapted to be plugged into and unplugged from the first receptacle, said second receptacle containing a pressure-sensitive element and an electric switch, means interengageable by plugging of the receptacles to each other to connect the pressure-sensitive element with the pressure line and the switch with the electric line and means mounted within the plug-in receptacle operably connecting the pressure-sensitive means with the switch for calibrating and adjusting the response of the switch to the pressure-responsive element.

22. An instrument according to claim 21 wherein the means operably connecting the pressure-sensitive means and the switch comprises an arm pivotally supported intermediate its ends within the plug-in receptacle with one end adjacent the pressure-sensitive element and the other adjacent the switch, and means for adjusting the resistance of the arm to pivotal movement by the pressure-sensitive element in response to pressure changes.

23. An instrument according to claim 22 comprising a threaded stud at the end of the arm adjacent the switch for engagement with the switch.

* * * * *